US005894750A

United States Patent [19]

Liaw

[11] Patent Number: 5,894,750

[45] Date of Patent: Apr. 20, 1999

[54] LOCK

[76] Inventor: Shyan-Tsair Liaw, No. 17, Lane 788, Yi Chiao St., Ting Chuang Li, Chiayi, Taiwan

[21] Appl. No.: 08/839,851

[22] Filed: Apr. 17, 1997

[30] Foreign Application Priority Data

Apr. 22, 1996 [TW] Taiwan ..... 85205894

[51] Int. Cl.[6] ..... E05B 27/04; E05B 35/08

[52] U.S. Cl. ..... 70/359; 70/378; 70/338; 70/493; 70/419

[58] Field of Search ..... 70/352, 356, 493, 70/494, 378, 384, 392, 419, 421, 359, 338, 358, 386, 337, 341–343

[56] References Cited

U.S. PATENT DOCUMENTS

| | | | |
|---|---|---|---|
| 429,361 | 6/1890 | McMahon | 70/378 |
| 649,255 | 5/1900 | Noack | 70/386 |
| 917,365 | 4/1909 | Schoell | 70/359 |
| 1,244,304 | 10/1917 | Epstein | 70/359 |
| 2,653,467 | 9/1953 | Segal | 70/359 |
| 2,710,536 | 6/1955 | Stephenson | 70/419 |
| 3,183,692 | 5/1965 | Check | 70/338 |
| 3,234,768 | 2/1966 | Russel et al. | 70/338 |
| 3,563,071 | 2/1971 | Barger | 70/378 |
| 3,818,732 | 6/1974 | Tria, Jr. et al. | 70/359 |
| 4,103,526 | 8/1978 | Surko, Jr. | 70/378 |
| 4,142,389 | 3/1979 | Bahry et al. | 70/359 |
| 4,151,731 | 5/1979 | Tucker | 70/386 |
| 4,429,554 | 2/1984 | Litvin et al. | 70/493 |
| 4,577,479 | 3/1986 | Widén | 70/493 |
| 4,760,722 | 8/1988 | Fann et al. | 70/378 |
| 4,905,489 | 3/1990 | Keller | 70/378 |
| 5,222,383 | 6/1993 | Fann et al. | 70/358 |

FOREIGN PATENT DOCUMENTS

| | | | |
|---|---|---|---|
| 0065813 | 12/1982 | European Pat. Off. | 70/357 |
| 2550242 | 12/1977 | Germany | 70/493 |
| 2055948 | 3/1981 | United Kingdom | 70/493 |

OTHER PUBLICATIONS

Lock Works, *Popular Science,* Jun. 1961, pp. 102–103.

*Primary Examiner*—Darnell M. Boucher
*Attorney, Agent, or Firm*—Hedman, Gibson & Costigan, P.C.

[57] ABSTRACT

A lock includes a casing, a cylindrical rod and a key, the casing having a longitudinal hole for the cylindrical rod received therein. The casing and the cylindrical rod have a main transverse hole device defined radially respectively therein and are in alignment with each other for receiving a main pin device therein, the cylindrical rod having a key hole defined longitudinally therein, at least one offset transverse hole device defined between the key hole and the main transverse hole device which is parallel to the offset transverse hole device so as to communicate with the main transverse hole device and the key hole, the offset transverse hole device having an offset pin device received therein, the offset pin device being lifted by a movement of the key inserted in the key hole to operate the main pin device to open the lock. In addition, the main pin device includes two hollow cylindrical pins for receiving two cylindrical pins and a ball-shaped pin, a recess defined in a periphery of the cylindrical rod for cooperating with the main pin device which is adjusted by a specific key.

10 Claims, 11 Drawing Sheets

LOCK

BACKGROUND OF THE INVENTION

1. Field of the Invention

The present invention relates to a lock in which at least one pin means is disposed.

2. Brief Description of the Prior Art

Some of traditional locks comprise a casing having a tubular hole defined longitudinally therein for receiving a cylindrical rod rotatably disposed therein. The casing and the rod each have a plurality of receiving holes in alignment with each other for biasedly receiving a plurality sets of pin means therein. Generally, each of the pin means consists of two cylindrical pins which are located in alignment with each other, or each of the pin means is composed of two hollow cylindrical pins which are located in alignment with each other, each of the two hollow cylindrical pins having a central hole defined therein for receiving a cylindrical pin. The cylindrical rod has a key hole defined therein which communicates with the receiving holes of the cylindrical rod such that a part of each pin means extends into the key hole. A suitable key has an engaging means which is generally formed to be a serrated configuration or recesses or cone-shaped recesses or protrusions. When a suitable key is inserted into the key hole, the engaging means can adjust the locations of the pin means so as to adjust the contacting surface of each pair of two cylindrical pins of each set of the pin means (or two hollow cylindrical pins) coincides with the inter-connecting surface between the casing and the cylindrical rod such that the lock can be unlocked and the cylindrical rod can be rotated corresponding to the casing by rotating the key.

The factors considered to ensure a safety feature and the numbers of assemblies of the pin means include: the positions and numbers of every single pin means which is treated as an unit, such as the configuration, the length and the size of each of the cylindrical pins or hollow cylindrical pins; the configuration and size of the key hole in the cylindrical rod, the configuration and structure of the key and by what manner the engaging means of the key is disposed.

Although these factors have been considered and utilized by the manufacturers in the art, it is not good enough for a need of having a safe and expandable lock.

SUMMARY OF THE INVENTION

It is an object of the present invention to provide a lock having high safety feature.

It is another object of the present invention to provide a lock having good expandable feature.

It is a further object of the present invention to provide a lock used in a new building.

It is still another object of the present invention to provide a lock used in a hotel so as to provide satisfactory security.

The lock in accordance with the present invention comprises:

a casing having a longitudinal hole defined therein, a cylindrical rod received in the longitudinal hole of the casing;

a main transverse hole means defined in the casing and communicating with the longitudinal hole defined in the casing;

a main transverse hole means defined in the cylindrical rod and being in alignment with the main transverse hole means of the casing;

a key hole defined longitudinally in the cylindrical rod;

an offset transverse hole means being disposed in the cylindrical rod and being parallel to the main transverse hole means of the cylindrical rod, communicating with the main transverse hole means of the cylindrical rod and the key hole;

a main pin means received in the main transverse hole means of the casing and the cylindrical rod;

an offset pin means which is maintained in and received in the offset transverse hole means of the cylindrical rod; and a key having an engaging means and being inserted into the key hole of the cylindrical rod to lift the offset pin means in the offset transverse hole means such that the offset pin means can lift the main pin means corresponding thereto.

The lock in accordance with the present invention having a cylindrical rod with the offset transverse hole means which further has a first offset transverse hole means.

The offset pin means includes at least a first offset pin means which is received in the first offset transverse hole means.

The engaging means of the key includes a first portion which can be engaged with the first offset pin means so as to let the first offset pin means lift the main pin means corresponding thereto.

The lock in accordance with the present invention having an offset transverse hole means which includes a plurality of first offset transverse hole means, each of which is parallel with the main transverse hole means of the cylindrical rod and communicates with the main transverse hole means of the cylindrical rod and the key hole, each of the first offset transverse hole means having the first offset pin means received therein.

The lock in accordance with the present invention having a key with an engaging means which includes a plurality of first portions, each of which is engaged with the first offset pin means corresponding thereto so as to lift the main pin means.

The lock in accordance with the present invention having a main pin means which includes at least two cylindrical pins in alignment with each other.

The lock in accordance with the present invention having a main transverse hole means which is a cylindrical hole, the first offset transverse hole means being disposed around the cylindrical hole and communicating therewith.

The lock in accordance with the present invention having the offset pin means which is at least a cylindrical pin or ball pin.

The lock in accordance with the present invention having the key with an engaging means which is at least a cone-shaped hole or recess or recess receiving a movable ball means.

The lock in accordance with the present invention having the offset hole means which further includes a second offset transverse hole means which is in parallel with the first offset transverse hole means.

The offset pin means further includes a second offset pin means which is received in the second offset transverse hole means.

The lock in accordance with the present invention having a key with the engaging means which further includes a second portion which can be inserted into the key hole so as to lift the second offset pin means received in the second offset transverse hole means such that the second offset pin means can lift the main pin means.

The lock in accordance with the present invention having a main pin means which includes a first pin means and a second pin means, the first pin means includes at least two hollow cylindrical pins in alignment with each other.

The second pin means includes at least two cylindrical pins in alignment with each other, the second pin means is coaxially received in the first pin means.

The lock in accordance with the present invention having a first offset pin means which is lifted by the first engaging portion of the key so as to let the first offset pin means lift the first pin means.

The second offset pin means can be lifted by the second portion of the key so as to let the second offset pin means lift the second pin means.

The lock in accordance with the present invention having the main pin means which includes a first pin means, a third pin means, the first pin means includes at least two hollow cylindrical pins in alignment with each other.

The third pin means includes two cylindrical pins in alignment with each other, the third pin means is disposed in the first pin means, the engaging means of the key including a first portion and a third portion which is separately disposed corresponding to the first portion such that the first portion can lift the first offset pin means, the first offset pin means can lift the first pin means and the third portion of the key can lift the third pin means.

The lock in accordance with the present invention having a first pin means which has two hollow cylindrical pins, in each of which the third pin means is received, a ball pin is disposed between the two cylindrical pins of the third pin means, the cylindrical rod has a recess defined in a periphery thereof such that a specific key can be inserted into the key hole to rotate the cylindrical rod relative to the casing to let the ball pin be received in the recess so as to change the arrangement of the third pin means.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
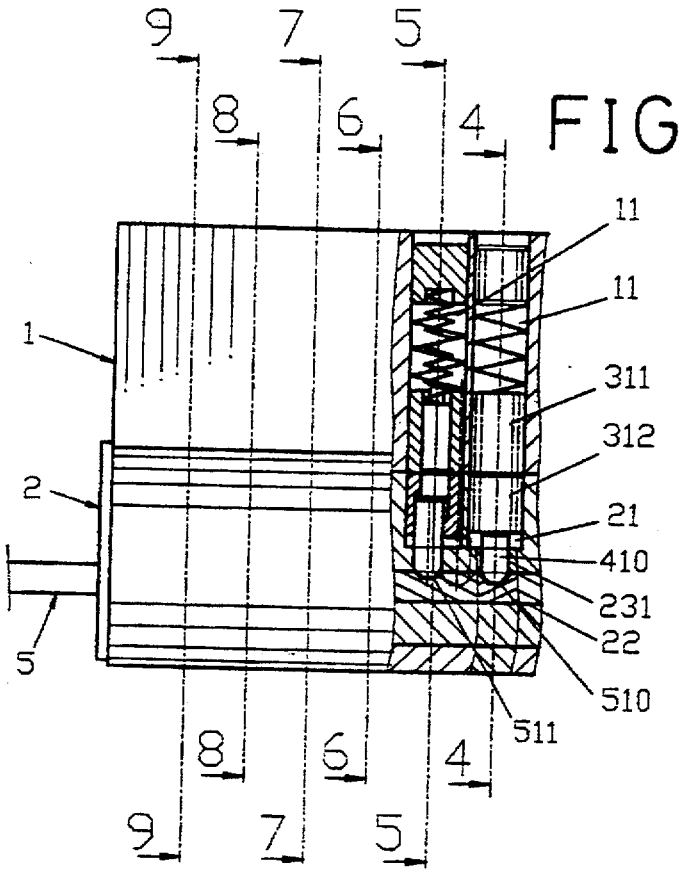
FIG. 1 is a side elevational view, partly in section, to show some principles of an embodiment of the present invention.

Referring to the drawings and initially from FIGS. 1 through 9, a lock in accordance with the present invention generally includes a casing 1 in which a longitudinal hole is defined and a rod or plug 2 which is received in the longitudinal hole. The casing 1 and the rod or plug 2 have a respective main transverse hole means 11, 21 defined therein which are in alignment with each other, a key hole 22 longitudinally defined in the rod 2.

Figure 9:
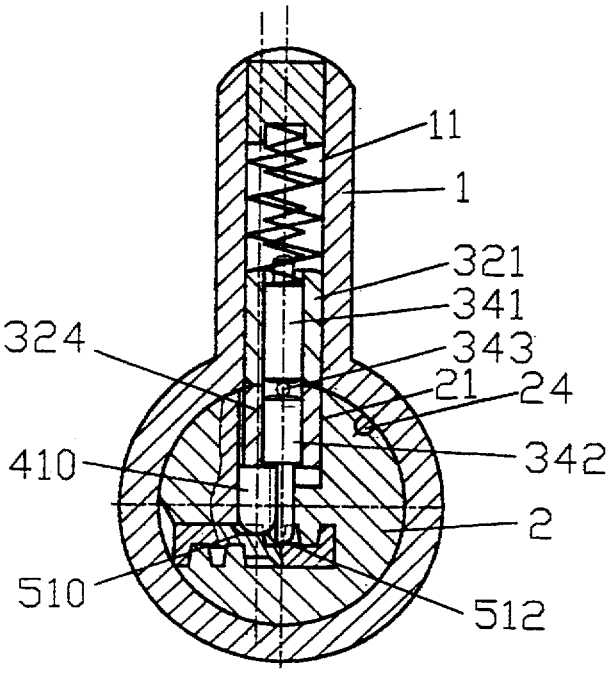
FIG. 9 is a sectional view taken from the plane along line 9—9 in FIG. 1.

The main transverse hole means 11, 21 of the casing 1 and the rod 2 have springs and main pin means received therein. The main pin means is generally composed of two (or more than two) cylindrical pins 311, 312 (FIG. 4), or two (or more than two) hollow cylindrical pins 321, 322 with two (or more than two) cylindrical pins 331, 332 received therein (FIGS. 5 and 6), or two (or more than two) hollow cylindrical pins 321, 324 with two (or more than two) cylindrical pins 341, 342 received therein (FIG. 7), or two (or more than two) hollow cylindrical pins 321, 324 with two cylindrical pins 341, 342 and a ball pin 343 received therein (FIG. 9).

Figure 2:
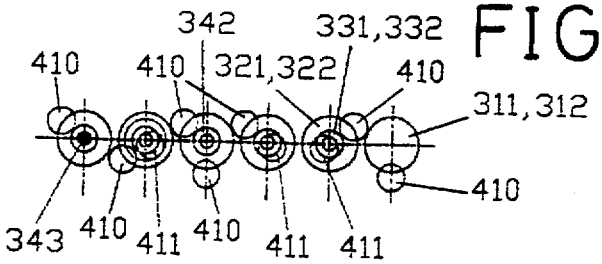
FIG. 2 is an illustrative view to show the arrangement of the pin means and the offset pin means in the lock shown in FIG. 1.
Figure 3:
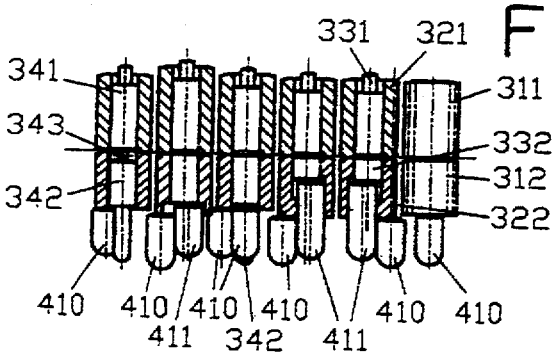
FIG. 3 is a side elevational view, partly in section, to show the arrangement of the main pin means and the offset pin means in the lock shown in FIG. 1.
Figure 4:
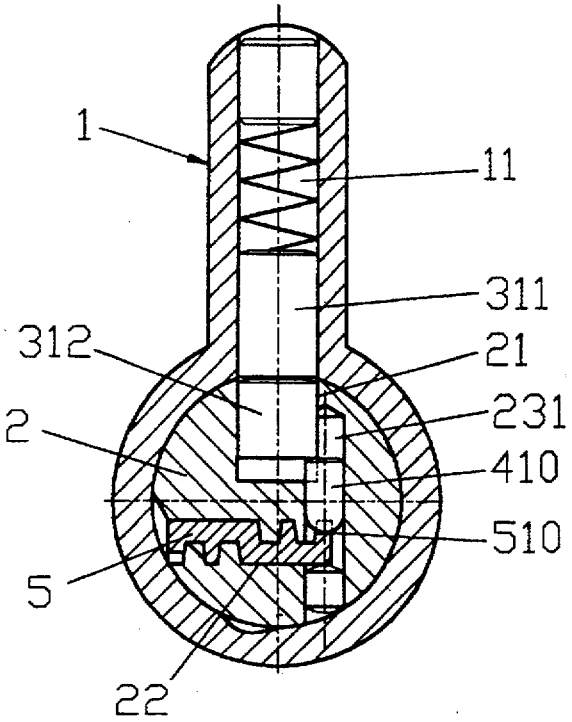
FIG. 4 is a sectional view taken from the plane along line 4—4 in FIG. 1.

Although, the configuration, size or length of each of the elements of the main pin means can be changed or varied or reassembled according to the safety factors considered of the lock, all the main pin means are in alignment with each other which provide only a limited safety feature. In order to increase the numbers of arrangements of the engaging means of the key or some specific requirements so as to expand the operations for the key actuating the main pin means from linear movements to planar movements. That is, the key actuating the main pin means is not limited to be operated along an axis of the main pin means and further parallely dispose some offset pin means beside (or under or around) the main pin means to increase the numbers of arrangements of the engaging means of the key and the safety of the lock. The arrangements shown in FIGS. 2 and 3 has selectably chosen the positions of the main pin means and the offset pin means 410, 411, the axes of the offset pin means 410, 411 are respectively parallel with the axes of the main pin means and the offset pin means 410, 411 are disposed to the positions where the offset pin means 410, 411 contact the main pin means as shown in FIGS. 2 and 3.

Accordingly, the relationship of positions between the main pin means and the offset pin means of the lock in accordance with the present invention can be adjusted for the sake of safety.

Figure 12:
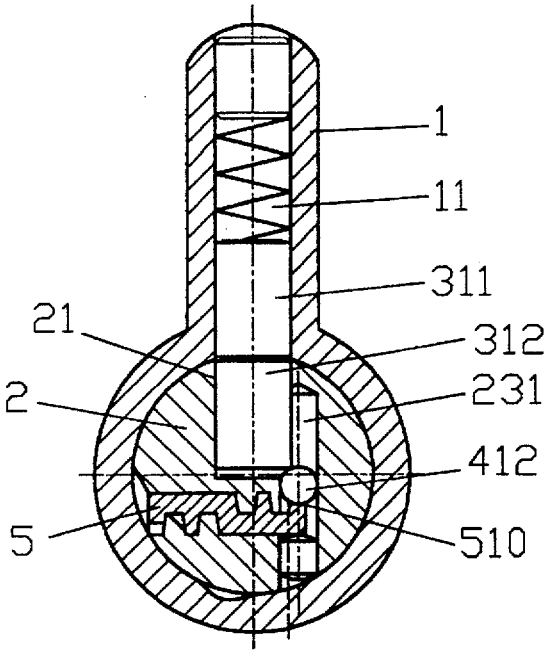
FIG. 12 is a sectional view similar to that of the FIG. 4, the cylindrical pin in the first offset hole means of the cylindrical rod in FIG. 4 is replaced by a ball pin.

Accordingly, the rod 2 of the lock has offset transverse hole means disposed between the main transverse hole means 21 and key hole 22 to let each of the offset transverse hole means communicate with the main transverse hole means 21 and the key hole 22 respectively such that the engaging means of the key 5 can be engaged with the offset pin means to let the offset pins lift the main pin means. Each of the offset transverse hole means has an axis nearly parallel to that of the main transverse hole means. In order to ensure the main pin means in the main transverse hole means 11, 21 of the lock have different arrangements so as to cooperate with the offset pin means, the offset transverse hole means generally includes: a first offset transverse hole means 231, a second offset transverse hole means 232, the first offset transverse hole means 231 having at least one offset pin means therein, the first offset pin means being at least one cylindrical pin 410 or ball pin 412, the first offset pin means 410 or 412 can be lifted by the first engaging means 510 of the key 5 such that the first offset pin means lift the cylindrical pins 311, 312 (FIGS. 4 and 12) of the corresponding main pin means, or two hollow cylindrical pins 321, 322 (FIGS. 5 and 6) , or two hollow cylindrical pins 321, 324 (FIGS. 7–9) to unlock the lock. The second offset pin means is received in the second offset transverse hole means 232, the second offset pin means being a cylindrical pin 411. The second offset pin means 411 can be lifted by the second engaging portions 511 of the key 5, the cylindrical pins 331, 332 of the corresponding main pin means also can be lifted (see FIGS. 5 or 6 or 8) so as to unlock the lock.

Figure 5:
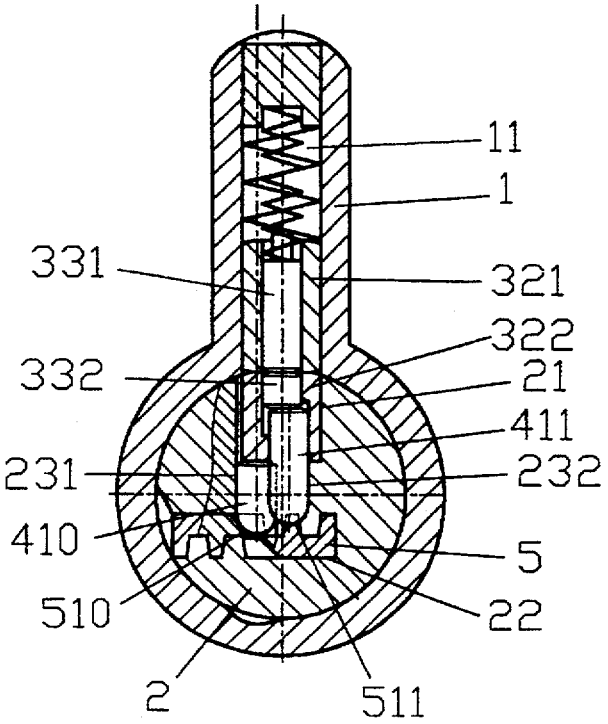
FIG. 5 is a sectional view taken from the plane along line 5—5 in FIG. 1.
Figure 6:
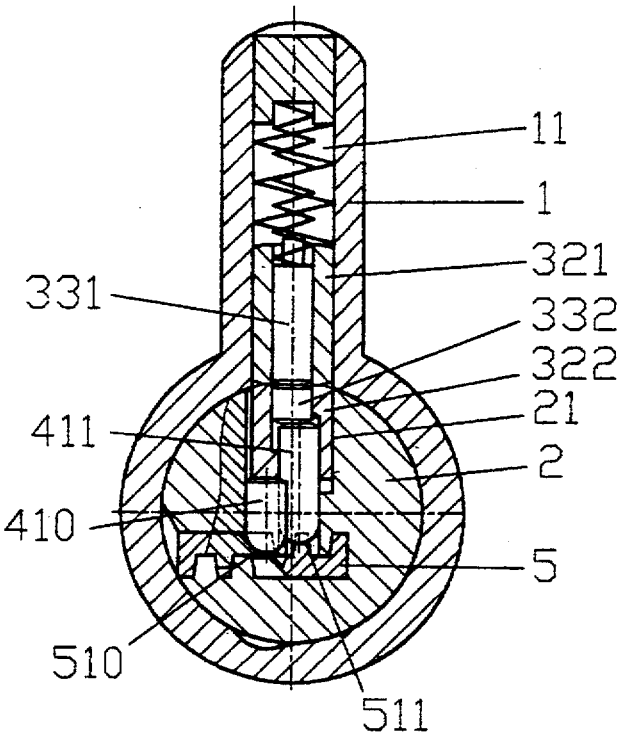
FIG. 6 is a sectional view taken from the plane along line 6—6 in FIG. 1.
Figure 8:
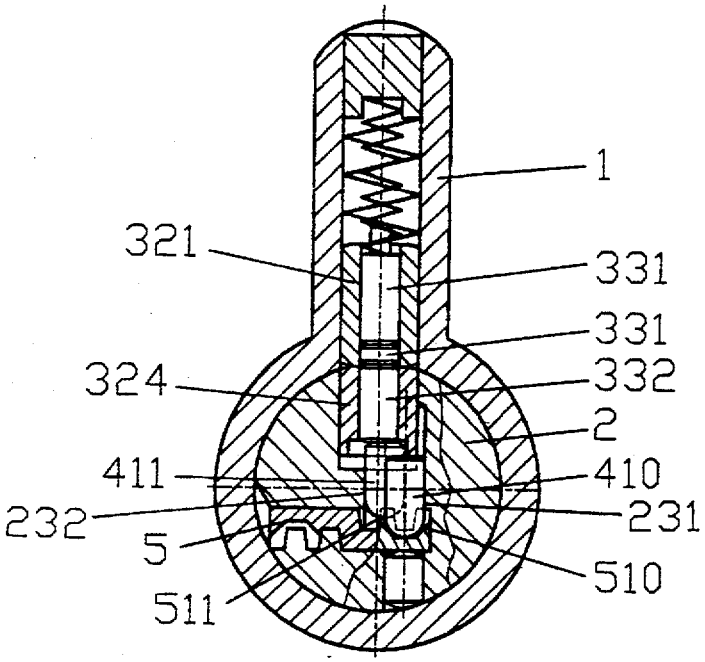
FIG. 8 is a sectional view taken from the plane along line 8—8 in FIG. 1.

One end of the second offset pin means 411 can be inserted into he hollow cylindrical pin 322 of the main pin means, the hollow cylindrical pin 322 in the FIGS. 5 or 6 having a central hole for receiving the cylindrical pin 332 therein and further having an offset hole (not numbered) which is parallel to the axis of the central hole of the hollow cylindrical pin 322. The offset hole allows the second offset pin means 411 to be inserted into the hollow cylindrical pin 322 to lift the cylindrical pin 332 to unlock the lock. Another design of the lock is shown in FIG. 8 wherein the hollow cylindrical pin 324 has a cylindrical hole (not numbered) defined in an end close to the second offset pin means 411, the cylindrical hole communicating with the central hole and allowing the second offset pin means 411 to be inserted into the hollow cylindrical pin 324 so as to lift the cylindrical pin 332 received in the hollow cylindrical pin 324 to unlock the lock.

The lock in accordance with the present invention can be modified to be used as a lock in a building, the lock is unlocked by a temporary key when the building is being built and can be changed to be a new arrangement by a specific key belonging to the owner of the building to operate the lock such that the temporary key will never unlock the lock.

Figure 10:
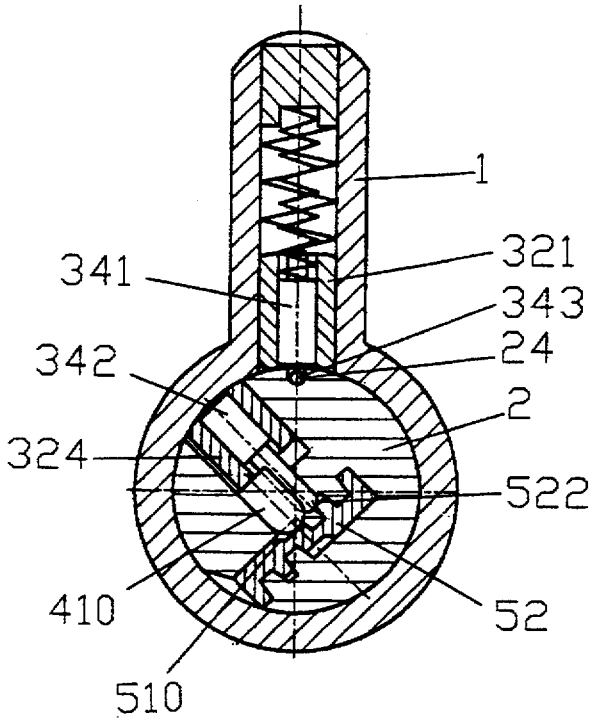
FIG. 10 is a sectional view to show the key shown in FIG. 9 is replaced by a specific key which is used to rotate the cylindrical rod c.c.w. relative to the casing to let the ball pin in the hollow cylindrical pin fall into the recess of the cylindrical rod.
Figure 11:
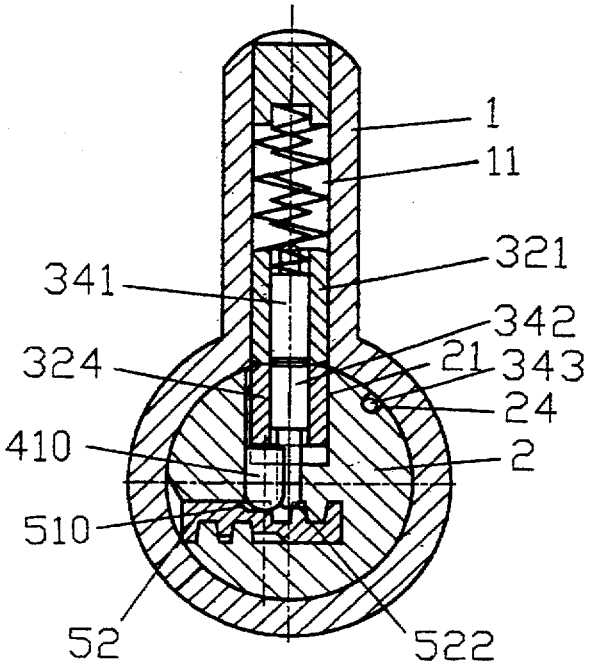
FIG. 11 is a sectional view to show the cylindrical rod which is rotated an angle relative to the casing by using the specific key shown in FIG. 10 to let the main transverse hole means of the cylindrical rod be in alignment with the main transverse hole means of the casing.

The lock having such a feature also can be one of the arrangements of the lock which can be added in the lock according to requirements of clients. That is to say, the lock having the feature mentioned above can be manufactured by disposing hollow cylindrical pins 321, 324 in the main transverse hole means 11, 21 of the casing 1 and the cylindrical rod 2 as shown in FIG. 9, a ball pin 343 is disposed between the two cylindrical pins 341, 342 in the hollow cylindrical pins 321, 324. The cylindrical rod 2 has a recess 24 defined in a periphery thereof, when the temporary key is inserted into the key hole in the cylindrical rod 2 as shown in FIG. 9), the third portion 512 of the key is engaged with the cylindrical pin 342 which lifts the ball pin 343 and the cylindrical pin 341 to let the contact surface between the ball pin 313 and the cylindrical pin 341 be coincident with the contact surface between the casing 1 and the rod 2. As shown in FIG. 10, the key in the key hole is the specific key 52 for the owner, which replaces the temporary key in FIG. 9, the third engaging portion 522 is engaged with the cylindrical pin 342 which lifts the ball pin 343 and the cylindrical pin 341 to let the contact surface between the ball pin 343 and the cylindrical pin 342 be coincident with the contact surface between the casing 1 and the rod 2 to let the lock can be unlocked, the specific key 52 together with the rod 2 are rotated c.c.w. by an angle relative to the casing 1 to let the ball pin 343 in the hollow cylindrical pin 321 fall into the recess 24 of the rod 2 (see FIG. 10).

The recess 24 is a slot allowing the ball pin 343 to be received therein and the ball pin 343 can enter from any position in the central hole of the hollow cylindrical pin 321, therefore, the width of the recess is preferred to be smaller than a diameter of the cylindrical pin 341, and larger than a diameter of the ball pin 343, the depth of the recess 24 is larger than the width thereof so as to let the ball pin 343 be slidably received therein and prevent the cylindrical pin 341 from being inserted therein so as to allow the rod 2 to rotate relative to the casing 1.

The rod 2 in FIG. 10 is rotated c.w. by an angle relative to the casing 1 with the specific key 52 inserted therein to let the main transverse hole means 21 of the rod 2 be in alignment with the main transverse hole means 11 of the casing 1, the cylindrical pins 341, 342 in the hollow cylindrical pins 321, 324 contact with each other such that the temporary key can never unlock the lock.

Figure 7:
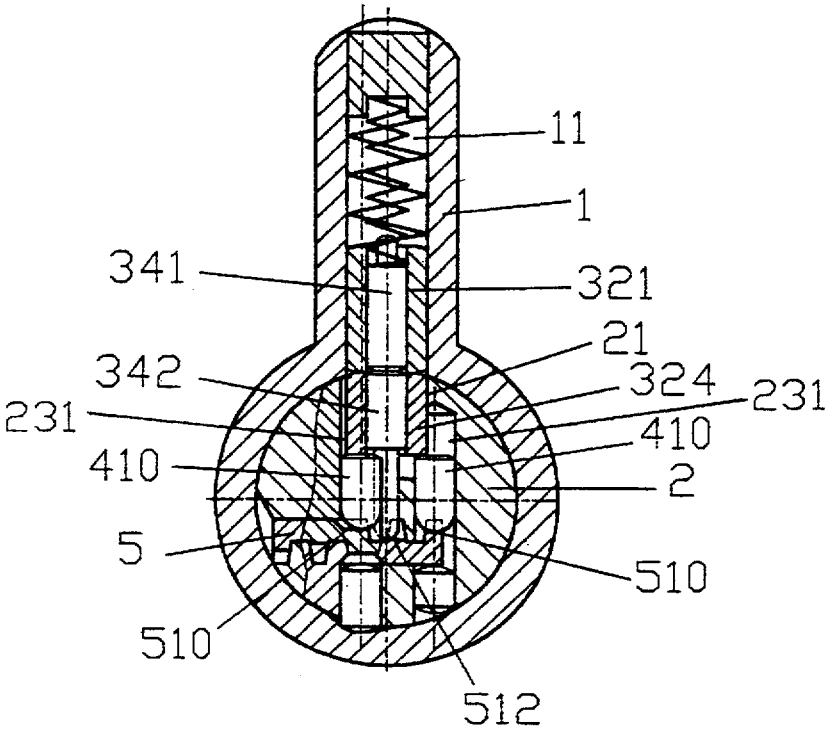
FIG. 7 is a sectional view taken from the plane along line 7—7 in FIG. 1.
Figure 13:
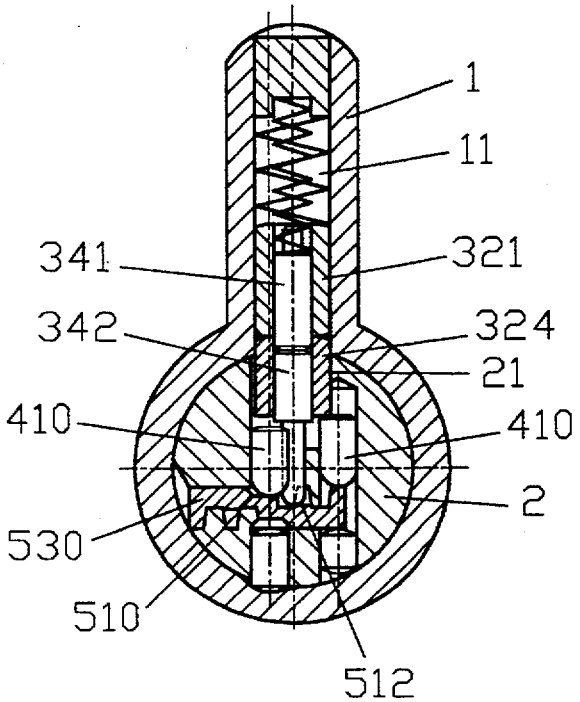
FIG. 13 is a sectional view similar to that of the FIG. 7, the key in FIG. 7 is replaced by another key which cannot unlock the lock.

A skilled person in the art of field should understand the lock in FIG. 7 has a first offset pin means 410 disposed on both right and left sides of the central axis of the main pin means respectively, the key 5 having two corresponding first portions 510, 510. FIG. 13 describes the key 5 used in the lock in FIG. 7 is replaced by another key 530 which has only a first portion 510 in the left side to be engaged with the first offset pin means 410 on the left side and has no corresponding portions to be engaged with the first offset pin means 410 on the right side such that the first offset pin means 410 in the drawing and the hollow cylindrical pins 324, 321 are lifted such that the contact surface between the two hollow cylindrical pins 324, 321 is not coincident with the contact surface between the casing 1 and the rod 2, the lock is therefore locked.

Figure 14:
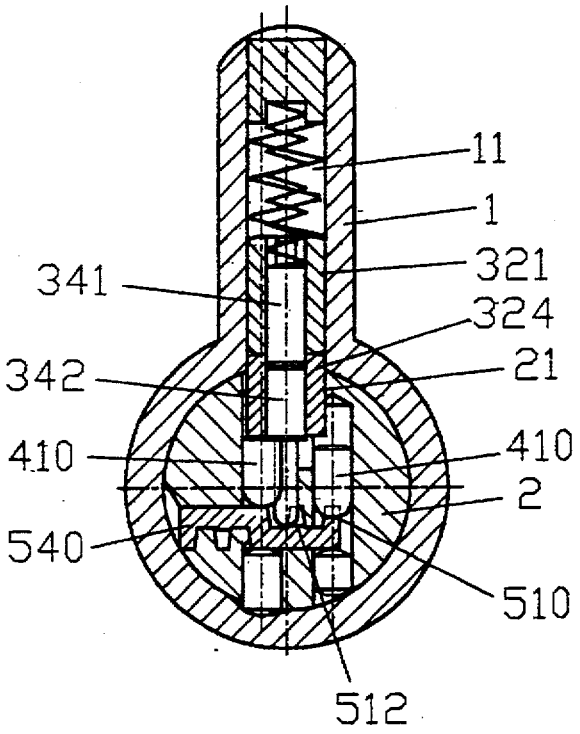
FIG. 14 is a sectional view similar to that of the FIG. 7, the key in the cylindrical rod in FIG. 7 is replaced by another key which cannot unlock the lock.

The key 5 in FIG. 7 has replaced by the key 540 in FIG. 14, the key 540 having only a first engaging portion 510 which can be engaged with the first offset pin means 410 on the right side in FIG. 14 and having no such a first engaging portion 510 to be engaged with the first offset pin means 410 on the left side in FIG. 14 such that the key 540 cannot unlock the lock.

Figure 15:
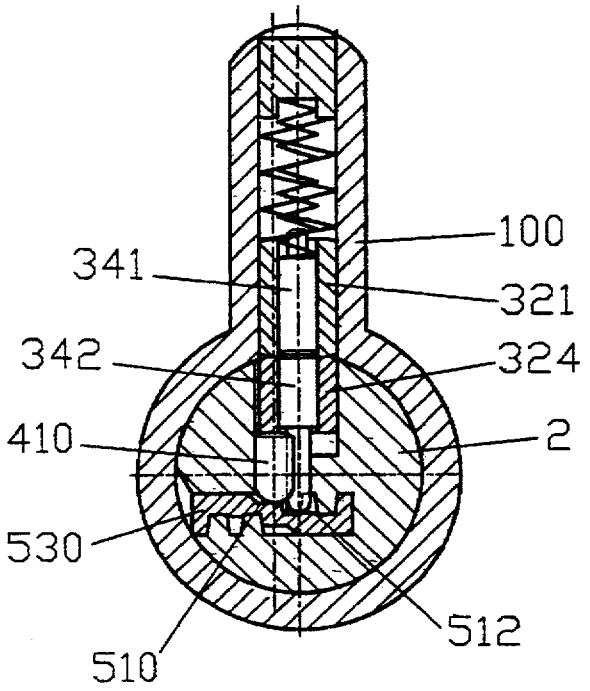
FIG. 15 is a sectional view similar to that of the FIG. 7, the cylindrical pin and the first offset transverse hole means on the right side of the central line of the cylindrical rod in FIG. 7 are omitted, such a lock can be unlocked by the key used in FIG. 13.
Figure 16:
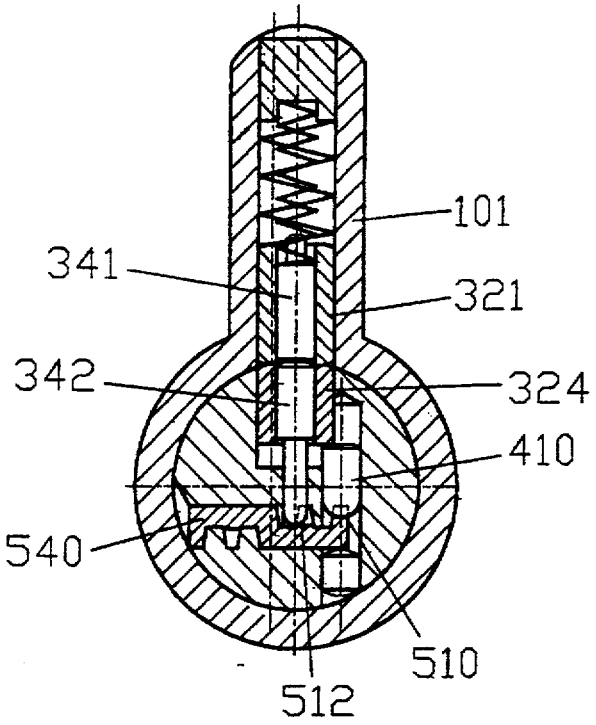
FIG. 16 is a sectional view similar to that of the FIG. 7, the cylindrical pin and the first offset transverse hole means on the left side of the central line of the cylindrical rod in FIG. 7 are omitted, such a lock can be unlocked by the key used in FIG. 14.
Figure 17:
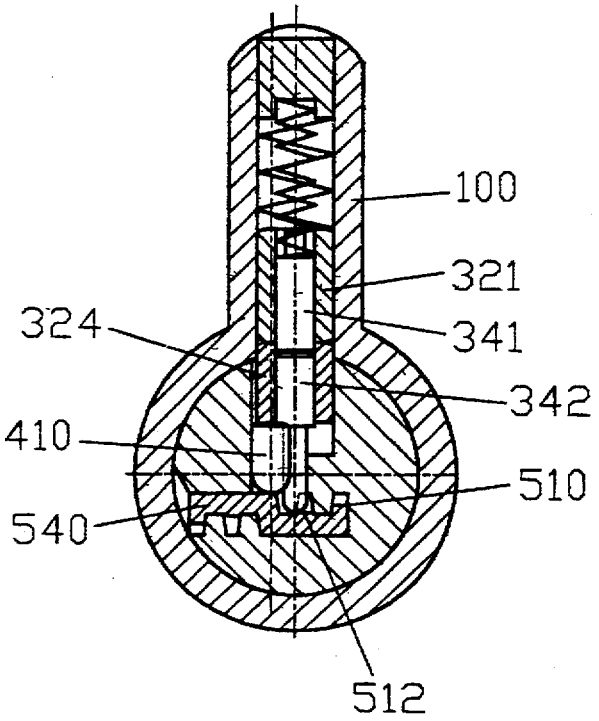
FIG. 17 is a sectional view similar to that of the FIG. 15, the key in the cylindrical rod in FIG. 15 is replaced by another key which cannot unlock the lock.
Figure 18:
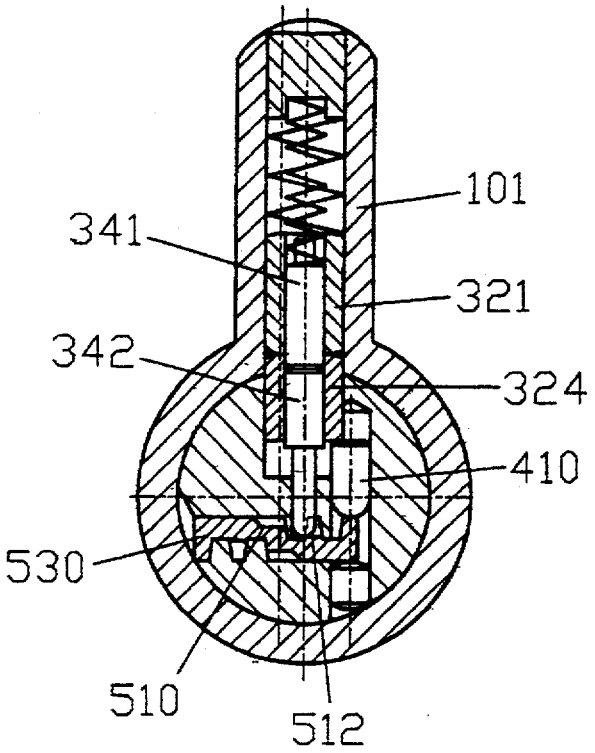
FIG. 18 is a sectional view similar to that of the FIG. 16, the key in the cylindrical rod in FIG. 16 is replaced by another key which cannot unlock the lock.
Figure 19:
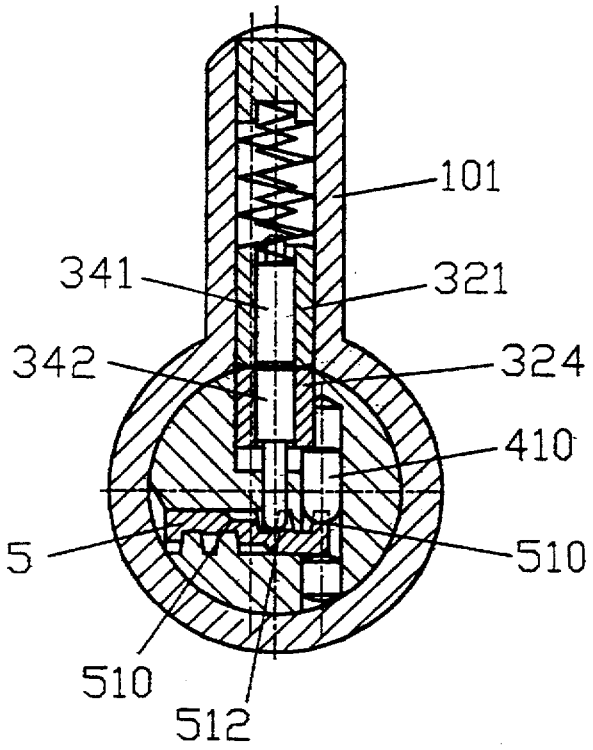
FIG. 19 is a sectional view similar to that of the FIG. 16, the key in the cylindrical rod in FIG. 16 is replaced by another key which can unlock the lock.
Figure 20:
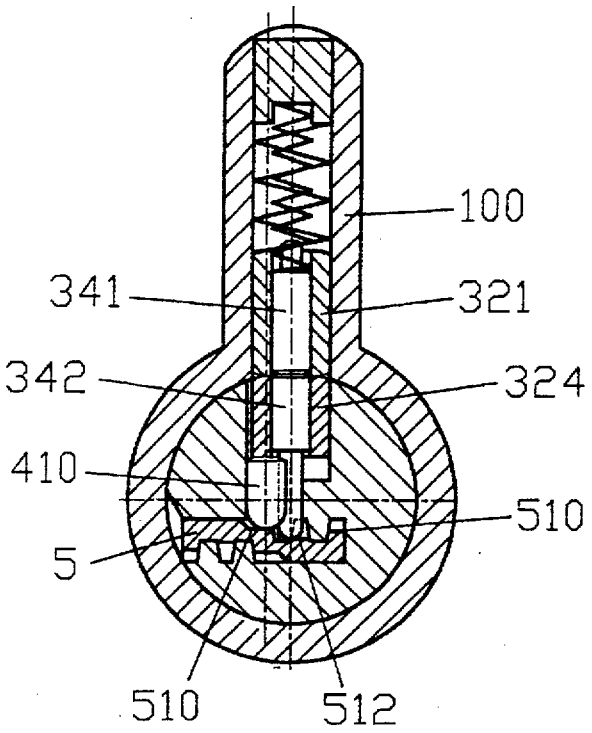
FIG. 20 is a sectional view similar to that of the FIG. 15, the key in the cylindrical rod in FIG. 15 is replaced by another key which can unlock the lock.

The above-mentioned main pin means and offset pin means can be arranged and determined to be disposed in a series of locks for being used in rooms of a hotel. The lock 100 as shown in FIG. 15 is similar to that shown in FIG. 7, wherein the first offset transverse hole means 231 on right side of the rod 2, the first offset pin means 410 and other structures as shown in FIG. 7 are omitted. Therefore, the lock 100 can be unlocked by the key 530. The lock 101 in FIG. 16 is similar to that in FIG. 7 wherein the first offset transverse hole means 231 on left side of the rod 2, the first offset pin means 410 and other structures as shown in FIG. 7 are omitted. Therefore, the lock 101 can be unlocked by the key 540. It is noted that the key 540 in the lock 101 shown in FIG. 16 cannot unlock the lock 100 shown in FIG. 15 (see FIG. 17), the key 530 in the lock 100 as shown in FIG. 15 cannot unlock the lock as shown in FIG. 16 (see FIG. 18), i.e., the key 530 used in the lock 100 shown in FIG. 15 cannot unlock the lock 101 shown in FIG. 16 and the key 540 used in the lock 101 shown in FIG. 16 cannot unlock the lock shown in FIG. 15, such that in a hotel, the key designed for unlocking the lock of one room cannot unlock another lock of another room. However, for convenience of management, it is required to have a key which can unlock all the locks, that is, the key 5 shown in FIG. 7 can unlock the locks 101 and 100 (see FIGS. 19, 20) because the key 5 has two first engaging portions 510.

It is understood that for a skilled person in the field of the art, the rod 2 and the key 5 are not limited to the designs as shown in FIGS. 1 through 9, it can be modified partly.

Figure 21:
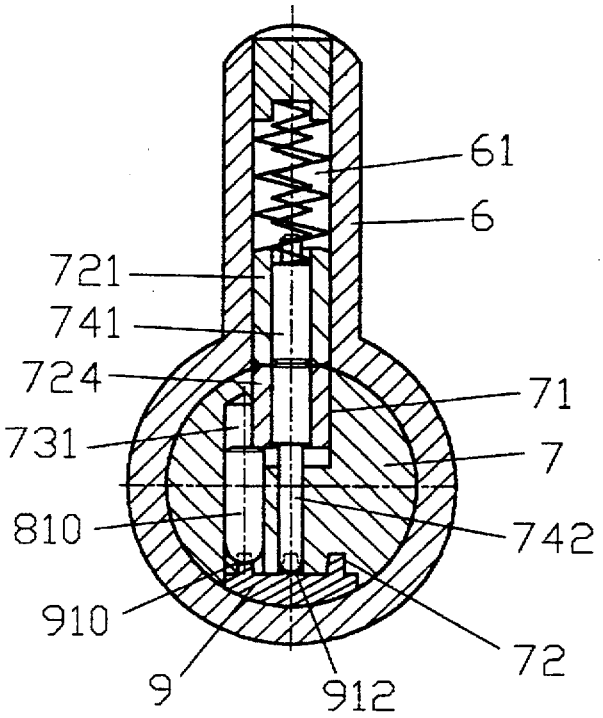
FIGS. 21 to 23 are side elevational views, partly in section, to show some principles of another embodiment of the present invention.
Figure 22:
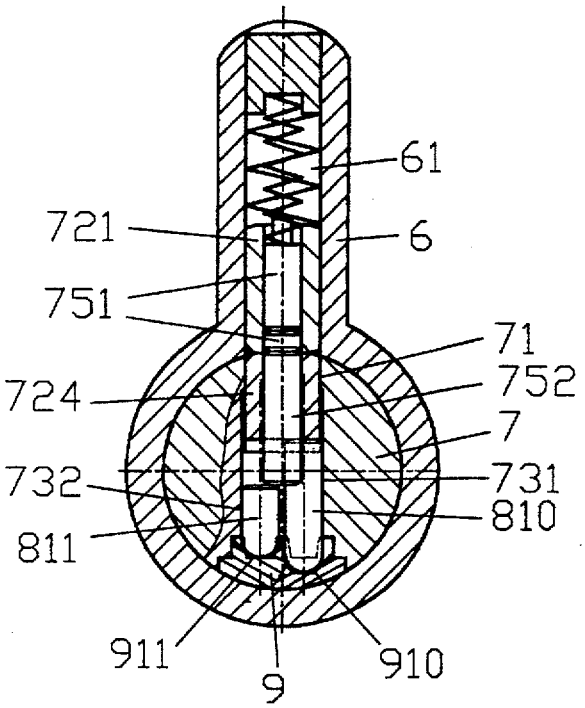
Figure 23:
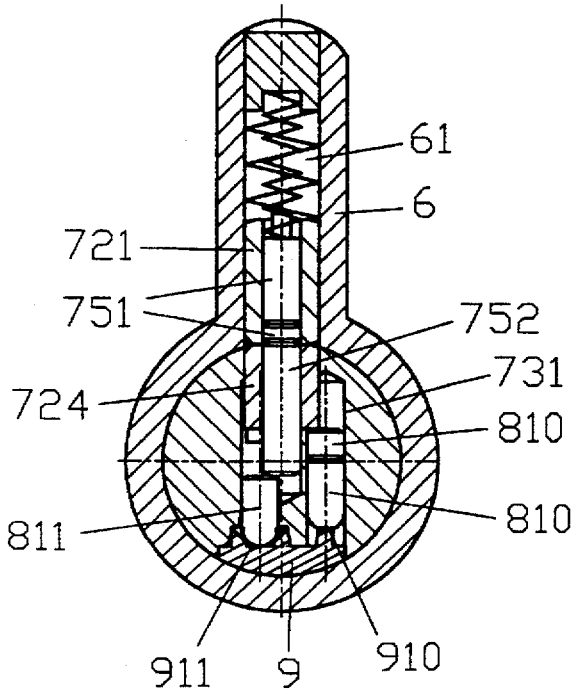

FIGS. 21 to 23 show a cross-sectional view of a modified key 9 and the position of the key hole, the offset transverse holes means and offset pin means of a modified rod 7.

The second offset pin means 811 received in the second offset transverse hole means 732, the first offset pin means 810 received in the first offset transverse hole means 731, the cylindrical pins 741, 742 (751, 752), the hollow cylindrical pins 721, 724 of the main pin means, the main transverse hole means 61, 71 of the casing 6 and the rod 7 as shown in the lock in FIGS. 21 to 23 and the key hole 72, all of these are similar to those shown in FIGS. 7 and 8 showing the second offset pin means 411 received in the second offset transverse hole means 232, the first offset pin means 410 received in the first offset transverse hole means 231, the cylindrical pins 341, 342 (331, 332), the hollow cylindrical pins 321, 324 of the main pin means, the main transverse hole means 11, 21 of the casing 1 and the rod 2. The key 9 in the lock as shown in FIGS. 21 to 23 has a first portion 910, a second portion 911, a third portion 912 which are corresponding to the first portion 510, the second portion 511, the third portion 512 of the key 5 in the lock as shown in FIGS. 7 and 8. The first portion 910 of the key 9 can lift the first offset pin means 810, the hollow cylindrical pins 721, 724 corresponding to the first portion 510 of the key 5 can lift the first offset pin means 410, the hollow cylindrical pins 321, 324. The second portion 911 of the key 9 can lift the second offset pin means 811, the cylindrical pins 751, 752 corresponding to the second portion 511 of the key 5 can lift the second offset pin means 411, the cylindrical pins 331, 332. The third portion 912 of the key 9 can lift the cylindrical pins 741, 742 which is similar to the third portion 512 of the key 5 lifting the cylindrical pins 341, 342.

Furthermore, the engaging means of the key of this invention also can be modified to be a recess receiving a movable ball means.

The embodiments are not deemed to limit the scope of the invention. The various modifications and alternative structures are located within the scope and the spirit of the appended claims of the invention.

What is claimed is:

1. A lock comprising:

a casing having a longitudinal hole defined therein and a plurality of first transverse holes defined therein and communicating with the longitudinal hole, each said first transverse hole including at least one first pin slidably received therein;

a cylindrical rod rotatably received in said longitudinal hole of said casing and including a plurality of second transverse holes defined therein, each said second transverse hole being in alignment with an associated said first transverse hole, the cylindrical rod further including a key hole longitudinally defined therein, said first transverse holes and said second transverse holes being located on a common longitudinal plane, each said first transverse hole and an associated said second transverse hole aligned therewith having a common first axis, each said second transverse hole including at least one second pin slidably received therein, said at least one first pin and an associated said second pin aligned therewith being slidable in the aligned associated first transverse hole and the associated second transverse hole;

each said first transverse hole including a biasing means for biasing said at least one first pin toward the associated said second pin; and at least one third transverse hole defined in said cylindrical rod and communicating with one of said second transverse holes, said at least one third transverse hole having a second axis extending in a direction parallel to said common first axis and not located on the common longitudinal plane of the first transverse holes and the second transverse holes, said at least one third transverse hole including a third pin slidably received therein for contacting with said second pin received in the second transverse hole communicated with said at least one third transverse hole, said at least one third pin being adapted to be actuated by a key to urge an associated said second pin and the associated first pin slidably received in the associated second transverse hole and the associated first transverse hole to a status for unlocking.

2. The lock according to claim 1, wherein the first pin is a hollow pin and further includes at least one fourth pin slidably received therein.

3. The lock according to claim 1, wherein the second pin is a hollow pin and further includes at least one fourth pin slidably received therein.

4. The lock according to claim 2, wherein the second pin is a hollow pin and further includes at least one fifth pin slidably received therein.

5. The lock according to claim 1, wherein the third pin is cylindrical.

6. The lock according to claim 1, wherein the third pin is spherical.

7. The lock according to claim 1, wherein the first pin is a first hollow pin and further includes a fourth pin slidably received therein and the second pin is a second hollow pin and further includes a fifth pin slidably received therein, at least one of the fourth pin and the fifth pin are slidable in the first hollow pin and the second hollow pin, and further comprises at least one fourth transverse hole defined in said cylindrical rod and communicating with one of said second transverse holes, said at least one fourth transverse hole having a third axis extending in a direction parallel to the second axis, said at least one fourth transverse hole including a sixth pin slidably received therein for contacting with said fifth pin received in the second hollow pin which, in turn, is received in the second transverse hole communicated with said at least one fourth transverse hole, said at least one third pin being adapted to be actuated by a key to urge an associated said first hollow pin and an associated said second hollow pin to a status for unlocking while said at least one sixth pin being adapted to be actuated by the key to urge an associated said fourth pin and an associated said fifth pin to a status for unlocking.

8. The lock according to claim 1, further comprising:

at least one fourth transverse hole defined in said cylindrical rod and communicating with one of said second transverse holes, said at least one fourth transverse hole having a third axis extending in a direction parallel to the second axis, said at least one fourth transverse hole including a fourth pin slidably received therein for contacting with said second pin received in the second transverse hole communicated therewith, said at least one fourth pin being adapted to be actuated by a key to urge the second pin and the first pin slidably received in the associated second transverse hole and the associated first transverse hole to a status for unlocking.

9. The lock according to claim 1, further comprising a ball pin mounted between the first pin and the associated second pin and slidably received in the first transverse hole and the second transverse hole, and the cylindrical rod further comprising a recess defined in an outer periphery thereof;

whereby the lock is unlockable by a first key and a second key when the ball pin is between the first pin and the associated second pin, and when the ball pin is received in the recess of the cylindrical rod upon rotation of the second key which is inserted into the key hole of the cylindrical rod, the first key is unable to unlock the lock yet the second key is still able to unlock the lock.

10. A lock comprising:

a casing having a longitudinal hole defined therein and a plurality of first transverse holes defined therein and communicating with the longitudinal hole, at least one of said first transverse holes including at least one hollow first pin slidably received therein;

a cylindrical rod rotatably received in said longitudinal hole of said casing and including a plurality of second transverse holes defined therein, each said second transverse hole being in alignment with an associated said first transverse hole, the cylindrical rod further including a key hole longitudinally defined therein, each said first transverse hole and an associated said second transverse hole aligned therewith having a common axis, at least one of said second transverse holes including at least one hollow second pin slidably received therein and contacting with an associated said at least one hollow first pin, said at least one hollow first pin including a third pin slidably received therein, said at least one hollow second pin having a fourth pin slidably received therein, at least one of the hollow first pin and the associated hollow second pin being slidable in the aligned associated first transverse hole and the associated second transverse hole, and at least one of the third pin and the fourth pin being slidable in the hollow first pin and the hollow second pin; and a ball pin mounted between the third pin and an associated said fourth pin and slidably received in the associated hollow first pin and the associated hollow second pin, and the cylindrical rod further comprising a recess defined in an outer periphery thereof, the recess being so dimensioned to completely receive the ball pin and to prevent from entrance of the third pin into the recess so as to ensure rotatable movement of the cylindrical rod relative to the casing, and the ball pin having a diameter smaller than that of the third pin;

whereby the lock is unlockable by a first key and a second key when the ball pin is between the third pin and the associated fourth pin, and when the ball pin is received in the recess of the cylindrical rod upon rotation of the second key which is inserted into the key hole of the cylindrical rod, the first key is unable to unlock the lock yet the second key is still able to unlock the lock.

* * * * *